US006398040B1

(12) United States Patent
Gregory

(10) Patent No.: US 6,398,040 B1
(45) Date of Patent: Jun. 4, 2002

(54) BALL HOLDER

(76) Inventor: David G. Gregory, 2775 35th St., Coos Bay, OR (US) 97420

( * ) Notice: Subject to any disclaimer, the term of this patent is extended or adjusted under 35 U.S.C. 154(b) by 0 days.

(21) Appl. No.: 09/688,008

(22) Filed: Oct. 13, 2000

Related U.S. Application Data

(60) Provisional application No. 60/161,888, filed on Oct. 27, 1999.

(51) Int. Cl.[7] ..... A47F 7/00

(52) U.S. Cl. ..... 211/14; 211/85.29; 211/113

(58) Field of Search ..... 211/14, 85.4, 13.1, 211/71.01, 85.26, 85.29, 113; 248/121, 127, 146, 149, 150, 151, 370, 158, 160, 163.1, 163.2, 164, 431, 432, 165, 440, 440.1, 176.1; D32/37

(56) References Cited

U.S. PATENT DOCUMENTS

| | | | | | |
|---|---|---|---|---|---|
| 505,797 | A | * | 9/1893 | Wastall | |
| 713,100 | A | * | 11/1902 | Hogeland | |
| 1,022,862 | A | * | 4/1912 | McMillen | |
| 1,172,439 | A | * | 2/1916 | Crozier | |
| D83,179 | S | * | 1/1931 | Scott et al. | |
| 1,896,446 | A | * | 2/1933 | Goeller | |
| 2,001,646 | A | * | 5/1935 | Abitsch | |
| 2,562,022 | A | * | 7/1951 | Duer | |
| D175,767 | S | * | 10/1955 | Hauser | D32/37 |
| D213,131 | S | * | 1/1969 | Hamilton | D32/37 |
| 4,561,547 | A | * | 12/1985 | Estwanik, III | 211/113 |
| 4,826,177 | A | * | 5/1989 | Ponte | |
| 4,830,199 | A | * | 5/1989 | Wolfe et al. | 211/86 |
| 4,948,077 | A | * | 8/1990 | Gonzalez | 248/164 |
| 5,273,298 | A | | 12/1993 | Brown | |
| 5,356,001 | A | | 10/1994 | Luna | |
| 5,470,039 | A | * | 11/1995 | Hilger | 248/164 |
| 5,474,188 | A | * | 12/1995 | McArdle | 211/13 |
| 5,553,719 | A | * | 9/1996 | Campbell | 211/113 |
| 5,615,769 | A | | 4/1997 | Stephenson | |
| 5,695,312 | A | | 12/1997 | Kelly | |
| 5,813,548 | A | * | 9/1998 | Jiang | |
| 5,823,360 | A | * | 10/1998 | Gorosave | 211/13.1 |
| D404,861 | S | * | 1/1999 | Balensiefer, II | D32/37 |
| 5,855,286 | A | | 1/1999 | Zaid | |
| 5,881,975 | A | | 3/1999 | Bianco | |
| 5,927,798 | A | * | 7/1999 | Ahn | |
| 6,059,126 | A | * | 5/2000 | Miller | 211/85.15 |
| 6,092,769 | A | * | 7/2000 | Brown | 248/166 |
| 6,174,266 | B1 | * | 1/2001 | Merrill | |

* cited by examiner

*Primary Examiner*—Daniel P. Stodola
*Assistant Examiner*—Jennifer E. Novosad
(74) *Attorney, Agent, or Firm*—Robert E. Howard

(57) ABSTRACT

A holder for a plurality of baseballs, softballs, or other types of balls. The holder is preferably comprised of three generally tubular support members that are joined together at their midsections, diverge outwardly and downwardly at their lower sections to form legs, and diverge outwardly and upwardly at their upper sections to form support arms. A cord is attached to the outer or upper ends of the support arms to form a cord hoop, and a net is suspended at its upper edges from the cord hoop. The net extends downwardly and is substantially closed at its bottom, thereby forming a ball receptacle.

5 Claims, 2 Drawing Sheets

BALL HOLDER

CROSS-REFERENCE TO RELATED APPLICATIONS

This application claims the benefit of U.S. Provisional Application No. 60/161,888, filed Oct. 27, 1999.

BACKGROUND OF THE INVENTION

This invention relates to a holder for various types of balls, such as baseballs, softballs, basketballs, volleyballs, soccer balls, tennis balls, golf balls, etc.

During practice for various athletic endeavors it is common for coaches to require repetitive interaction between the athletes and the ball used in their sport. For example, during baseball or softball practice coaches are called upon to throw a number of consecutive balls for batting or fielding practice. Typically a number Of balls are placed into a container and carried to the place where the coach will be doing his throwing. The container is placed on the ground, or the balls dumped on the ground, and the coach must reach down to ground level each time he needs a fresh ball.

SUMMARY OF THE INVENTION

It is an object of this invention to provide a portable holder for a group of balls that presents the balls at an elevated height so that the balls are easily accessible to the user.

The holder of this invention is comprised of at least three support members that are joined together at their midsections, diverge outwardly and downwardly at their lower sections to form legs, and diverge outwardly and upwardly at their upper sections to form support arms. A cord is attached to the outer ends or the upper sides of the support arms to form a hoop and a net is suspended at its upper edges from the cord hoop, the mid-portion of the net extending downwardly to form an open mesh receptacle for balls.

In a preferred embodiment all of the support arms have identical lengths, and the cord hoop supporting the net can be attached to one of a plurality of attachment points located either at the end of the arm or along its upper side to allow the cord to be attached to all of the support arms at the same elevation or at different elevations.

In an alternative embodiment, one of the support arms is longer than the other support arms so that the net attached thereto forms an elongated ball receptacle.

In a still further embodiment, a longer support arm is provided that has an upper end that is higher than the upper ends of the shorter support arms so that the floor of the net slopes downwardly toward the shorter support arms.

DESCRIPTION OF PREFERRED EMBODIMENTS

Figure 1:
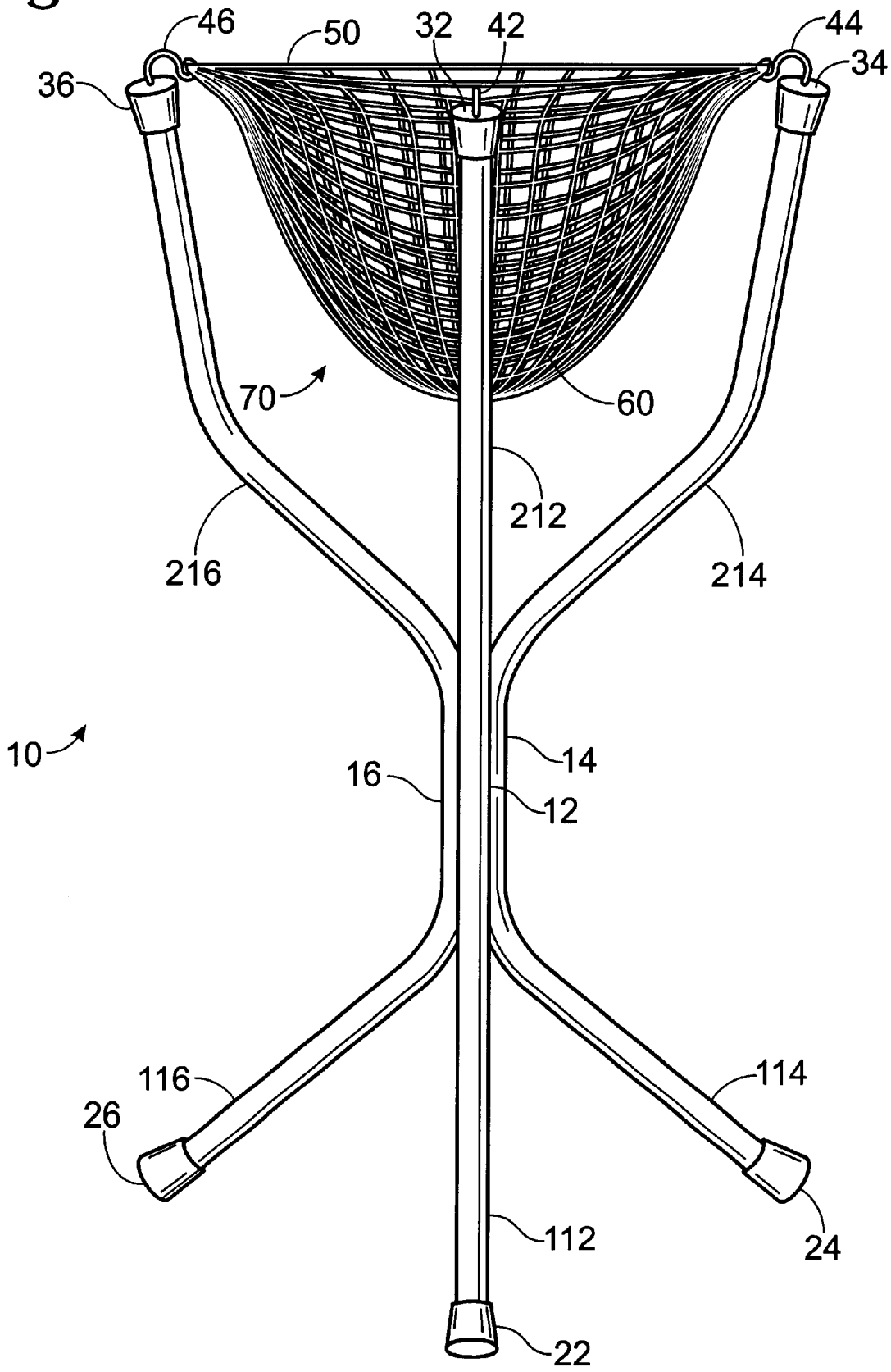
FIG. 1 is a perspective view of a preferred embodiment of the ball holder of this invention.

With reference to FIG. 1, the ball holder 10 of the invention is comprised of three support members 12, 14, and 16. Support members 12, 14, and 16 are attached together at their mid-sections, as shown. Support members 12, 14, and 16 are preferably tubular (preferably having a circular cross-section), and preferably formed of galvanized pipe.

Support members 12, 14, and 16 are preferably attached together by use of nuts and bolts wherein each support member is attached to each adjacent support member by a nut and bolt. However, the support members could be attached by welding or any other suitable attachment means.

Support members 12, 14, and 16 diverge outwardly and downwardly to form three leg members 112, 114, and 116, respectively. Leg members 112, 114, and 116 are identical in configuration and length.

Support members 12, 14, and 16 diverge outwardly and upwardly to form three support arms 212, 214, and 216, respectively. Support arms 212, 214 and 216 are preferably identical in configuration and length.

Foot caps 22, 24, and 26 are attached to the outer ends of legs 112, 114, and 116, respectively. Foot caps 22, 24,and 26 are, preferably, made of a smooth plastic such as polyvinyl chloride ("PVC"). Alternatively, casters or wheels may be attached to the outer ends of legs 112, 114, and 116 to allow ball holder 10 to be rolled about.

Upper end caps 32, 34, and 36 are attached to the outer ends of arms 212, 214, and 216, respectively. End caps 32, 34, and 36 are, preferably, made of PVC.

A cord, preferably an elastic bungee cord, has its ends fastened together to form a cord hoop 50. Cord hoop 50 is, substantially, an equilateral triangle, the length of each leg of the triangle being substantially the distance between adjacent upper ends of support arms 212, 214, and 216.

Figure 2:
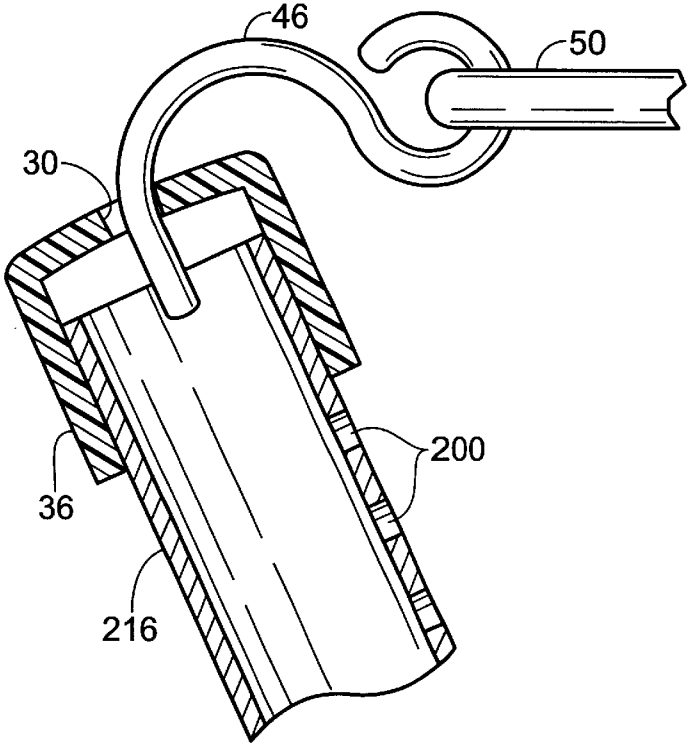
FIG. 2 is a partial side view, partially in cross-section, showing the relationship of the upper end of a support arm, cord hoop and cord hoop attachment hook of a preferred embodiment of the ball holder of this invention.

Cord hoop 50 has modified "S" hooks 42, 44, and 46 attached thereto at three substantially equidistant locations. Hooks 42, 44, and 46 are adapted to be attached to the upper ends of support arms 212, 214, and 216 as shown in FIG. 2 relative to "S" hook 46 and support arm 216.

The "S" hooks 42, 44, and 46 are commercially available "S" hooks that have been modified by crimping one end of the hook around cord hoop 50 (the "closed" end) and pulling the other end of the hook away from the main hook body (the "open" end). Hooks 42, 44, and 46 are identical in construction.

The open ends of hooks 42, 44, and 46 can be inserted into openings 30 located in the tops of end caps 32, 34, and 36, or into openings 200 located in the upper ends of support arms 212, 214, and 216. Such openings are shown relative to support arm 216 in FIG. 2 wherein opening 30 passes through the top of cap 36 and openings 200 pass through the upper end of support arm 216. Identical openings, both as to size and spacing, pass through caps 32 and 34 and the upper ends of support arms 212 and 214.

The perimeter of hoop 50 is such that when hooks 42, 44, and 46 are attached to the tops or adjacent the tops of support arms 212, 214, and 216, the bungee cord forming cord hoop 50 is under tension.

A net 60 is suspended from cord hoop 50 to form a receptacle 70 for balls. Net 60 is preferably attached to cord hoop 50 by passing it through the upper row of meshes before attaching the ends of the cord together. However, net 60 can be attached to cord hoop 50 in any other suitable manner, such as by use of string, wire, clips, etc.

Receptacle 70 is open at the top and totally, or substantially totally, closed at the bottom. Receptacle 70 can be formed from net material 60 in any manner known in the art. For example, receptacle 70 can be formed by bringing together the two ends of a rectangular piece of netting, fastening them together to form a cylinder, and closing off the bottom end of the thus formed cylinder by sewing the netting together.

Net 60 can be formed of any netting material, such as nylon. A preferred netting material for baseballs or larger diameter balls is called "golf web", and is a "number 24" web having 1.75 inch openings.

The height of support members 12, 14, and 16, the height of legs 112, 114, and 116, and the height of arms 212, 214, and 215 are selected so that receptacle 70 is approximately at waist height for an adult. The spacing and height of support arms 212, 214, and 216, and the depth of receptacle 70, are selected to optimize the number of balls to be held in receptacle 70, taking into account the weight and volume of the balls, and the practice regimen in which they are to be used.

Figure 3:
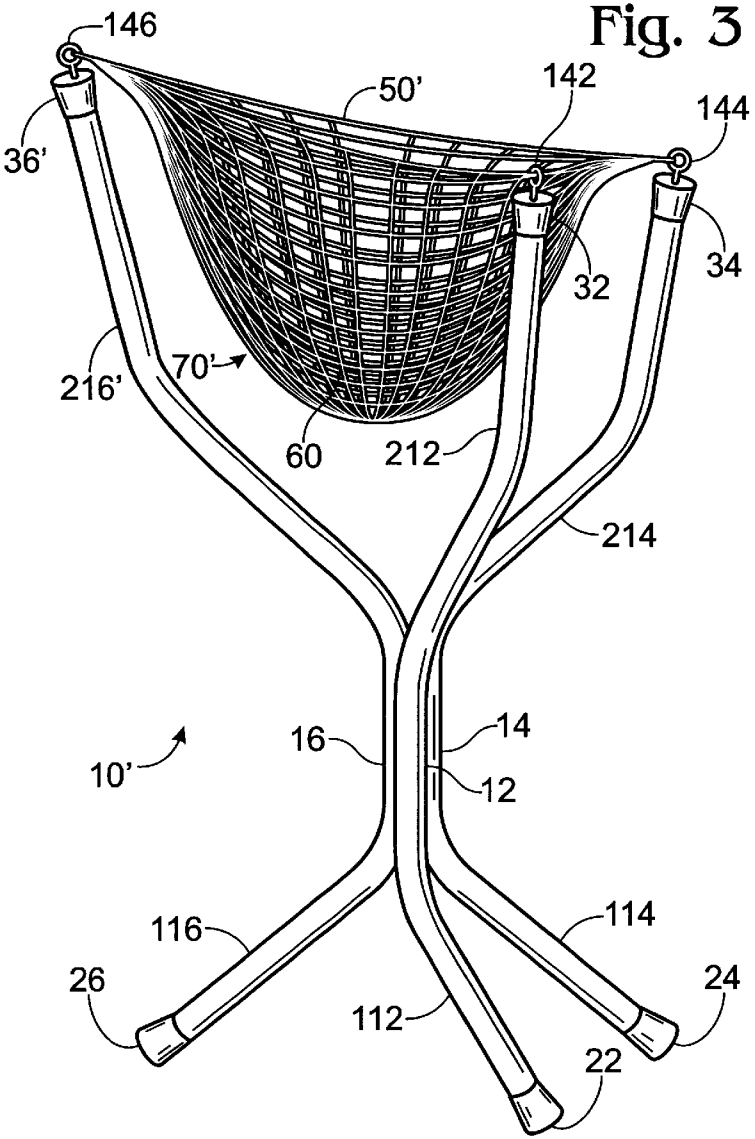
FIG. 3 is a side view of a second embodiment of the ball holder of this invention.

FIG. 3 illustrates another embodiment of the invention. Parts common to the embodiment illustrated in FIGS. 1 and 2 have the same reference numerals. The primary difference between ball holder 10' illustrated in FIG. 3 over ball holder illustrated in FIG. 1 is that arm 216' of FIG. 3 is longer than support arms 212 and 214, and the outer end of support arm 216' is higher above ground level than the outer ends of support arms 212 and 214. Cord hoop 50' is shown in FIG. 3 as being attached to endcaps 32, 34, and 36' by means of eyebolts 142, 144, and 146 mounted therein; however, cord hoop 50' can be attached to endcaps 32, 34, and 36' by means of "S" hooks as described above.

Receptacle 170 in the embodiment of FIG. 3 has an elongated shape. In addition, the floor of receptacle 170 of the FIG. 3 embodiment slopes downwardly from arm 216' towards arms 212 and 214 so that balls placed into receptacle 70 roll down towards arms 212 and 214. The same effect could be achieved in the embodiment illustrated in FIG. 1 by attaching "S" hook 46 to endcap 36 and "S" hooks 42 and 44 to one of the lower holes 200 located in upper support arms 212 and 214, respectively.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A ball holder comprised of three support members joined together at their mid-sections, said support members diverging outwardly and downwardly to form three legs, said support members diverging outwardly and upwardly to form three support arm, and a flexible receptacle suspended from said three arms for holding balls, a first one of said three support arms being longer than the other two arms, said first one of said arms having an upper end that is higher than the upper ends of said other two arms.

2. A ball holder comprised of three tubular support members, each said tubular support member having an upper section, a lower section and a mid-section, said mid-sections of said support members having substantially parallel longitudinal axes, each said tubular support member being joined to each of the other said tubular support members at their mid-sections, said support members diverging outwardly and downwardly from their mid-sections to form three legs, said support members diverging outwardly and upwardly from their mid-sections to form three support arms, each of said support arms having outer ends covered by end caps, each of said end caps having an opening therein adapted to receive an attaching means, a hoop formed of a bungee cord removably attached to said end caps by said attaching means, and a receptacle formed of netting material suspended from said hoop, said receptacle having a top that is open, a bottom that is substantially closed, and a mid-portion extending downwardly between said top and bottom, said receptacle having a depth adapted to hold a plurality of balls.

3. The ball holder of claim 2 wherein said attaching means are hooks.

4. A ball holder comprised of three tubular support members, each said tubular support member having an upper section, a lower section and a mid-section, said mid-sections of said support members having substantially parallel longitudinal axes, each said tubular support member being joined to each of the other said tubular support members at their mid-sections, said support members diverging outwardly and downwardly from their mid-sections to form three legs, said support members diverging outwardly and upwardly from their mid-sections to form three support arms, each of said support arms having a plurality of openings therein in their upper sections, said openings adapted to receive attaching means, a hoop formed of a bungee cord removably attached to said arms by said attaching means, and a receptacle formed of netting material suspended from said hoop, said receptacle having a top that is open, a bottom that is substantially closed, and a mid-portion extending downwardly between said top and bottom, said receptacle having a depth adapted to hold a plurality of balls.

5. The ball holder of claim 4 wherein said attaching means are hooks.

* * * * *